US006026906A

United States Patent [19]

Oliphant

[11] Patent Number: 6,026,906

[45] Date of Patent: Feb. 22, 2000

[54] LID RETAINER FOR MONITORING WELL

[76] Inventor: Michael N. Oliphant, 15605 Avenida Alcachofa, #H, San Diego, Calif. 92128

[21] Appl. No.: 09/002,304

[22] Filed: Dec. 31, 1997

[51] Int. Cl.[7] ..... E02D 29/14

[52] U.S. Cl. ..... 166/379; 404/26; 220/315

[58] Field of Search ..... 166/75.13, 96.1, 166/379; 137/371; 404/26; 52/20; 220/315, 327, 328, 484

[56] References Cited

U.S. PATENT DOCUMENTS

| | | | |
|---|---|---|---|
| 4,660,736 | 4/1987 | Mays | 220/327 |
| 4,971,149 | 11/1990 | Roberts | 166/92 |
| 5,010,957 | 4/1991 | Kenner | 166/379 |
| 5,058,633 | 10/1991 | Sharp | 141/86 |
| 5,195,590 | 3/1993 | Kenner | 166/379 |

*Primary Examiner*—David Bagnell
*Assistant Examiner*—Sunil Singh
*Attorney, Agent, or Firm*—Frank G. Morkunas

[57] ABSTRACT

An improved lid retainer for a ground-water monitoring well of the type having a housing, a water-tight lid, and a lid fastener for fastening the lid to the housing. The lid retainer has a lid fastener receiving member which cooperates with the lid fastener, a flexible horizontal brace member and a flexible vertical brace member, each connected to the lid fastener receiving member and adapted to be contourable to the shape of the inner surface of the housing of the monitoring well and to provide support therefor. Each brace member has an attachment structure, such as an aperture, for attaching the lid retainer to the housing by suitable fasteners. Preferred fasteners include concrete anchors.

4 Claims, 2 Drawing Sheets

LID RETAINER FOR MONITORING WELL

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to a ground water monitoring well and more particularly to an improved lid retainer therefor.

Ground water monitoring wells are routinely used in areas where ground water contamination can occur. Such locations include, but are not limited to, solid waste landfills, chemical plant factories, gas stations, areas where storage tanks (above or underground) are placed, and other locations where there is a potential for spills or leaks of hazardous or toxic substances (hereafter referred to as hazardous substance) and concomitant exposure onto or into the ground. At such locations, to ensure that ground water has not been contaminated by the hazardous substances, ground water monitoring wells (environmental monitoring wells) have been installed.

These wells are adapted to collect ground water from below the surface and hold it therein for testing. Testing is conducted regularly to ensure the quality of the underground water table generally used as a drinking water supply or other similar uses associated with living matter. Regularly testing or sampling of the ground water provides an early indication of contamination or the onset of contamination. The ability to detect a potential contamination problem at its incipient stage permits the responsible authorities to act immediate to curtail continued contamination and facilitates remedial action.

Typically, these monitoring wells have holding tanks or housing units which are inserted into the ground. They are encased in concrete. A monitoring member or pipe-like structure projects from the bottom of the housing, through the concrete, and further down into the surface of the earth. Generally, these monitoring members have a plurality of apertures or slits thereon to permit passage of water into the monitoring member for collection therein for sampling.

Because of the ramifications associated with test results which reveal contaminants, accuracy of testing is important. The ground water sample must not be contaminated from any source other than that which comes from the ground water. The integrity of the monitoring well, therefore, must be maintained at all times or else the tests may yield inaccurate results and thereby cause unnecessary concern, reaction, and remediation costs. Potential contaminants must be kept from entering the monitoring well. To this end, these monitoring wells have lids which form water-tight seals when seated and tightened down. Fasteners such as bolts insert through the lid and fasten to a cooperating nut or other receiving member suited for the intended purpose. The receiving member is generally fixedly attached to and is an integral part the inner surface of the housing. In many monitoring wells, the receiving member is a tab-like structure connected to the inner surface of the housing. The tab-like structure contains the receiving member; generally a threaded hole to receive a bolt with corresponding threads.

Since these monitoring wells are in the ground they are exposed to the environment and all the perils associated therewith. They may be walked on, driven on, or even vandalized. More typically at a setting such as a gas station, they are, more likely than not, driven over repeatedly. Proper seating requires that the lid fastener be fully seated and flush with the lid's upper outer surface or recessed therein. This will prevent damage to the tab-like receiving member should a vehicle drive over the monitoring well and the lid fastener. If a lid fastener is not fully and properly seated, however, it will protrude from the lid's upper outer surface. In this condition, the weight and pressure produced by objects (such as cars and trucks) driving over the exposed and protruding fastener transfers that pressure downward to its cooperating tab-like receiving member. The receiving member could become damaged or break completely off the inner surface of the housing and thereby adversely affect and breach the water-integrity of the monitoring well. It is extremely costly to repair a monitoring well of this type which is damaged in this matter. Generally, the entire well must be removed and replaced. In many cases this includes replacing the concrete encasing. No other means currently exists to simply repair or replace the damaged tab-like receiving member in an efficient and cost-effective manner.

Other monitoring wells have been configured to deal with this problem by not using tab-like receiving members or by making the receiving member more sturdy. See U.S. Pat. No. 5,195,590 issued on Mar. 23, 1993, to Kenner; U.S. Pat. No. 5,010,957 issued on Apr. 30, 1991, also to Kenner; and U.S. Pat. No. 4,971,149 issued on Nov. 20, 1990, to Roberts. Although these patents are suited for the intended purpose, they do not account for the many monitoring wells currently in place and being used which have tab-like receiving members of the type described above and which, if damaged, are costly to repair. The present invention provides an alternative to replacing the entire monitoring well when the tab-like receiving members have been damaged. None of the prior art patents and devices provide for such flexibility and cost-effectiveness.

Accordingly, several objects and advantages of my invention are to:

a. provide a low-cost means to repair existing monitoring wells having tab-like receiving members;

b. provide a low-cost alternative to replacing an entire monitoring well when such monitoring well's tab-like receiving members are damaged or broken; and c. to maintain the water-tight integrity of existing monitoring wells without undue expense or time expenditure.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an improved lid retainer for a ground-water monitoring well of the type having a housing, a water-tight lid, and a lid fastener for fastening the lid to the housing. The lid retainer has a lid fastener receiving member which cooperates with the lid fastener, a flexible horizontal brace member and a flexible vertical brace member, each connected to the lid fastener receiving member and adapted to be contourable to the shape of the inner surface of the housing of the monitoring well and to provide support therefor. Each brace member has an attachment structure, such as an aperture, for attaching the lid retainer to the housing by suitable fasteners.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 2:
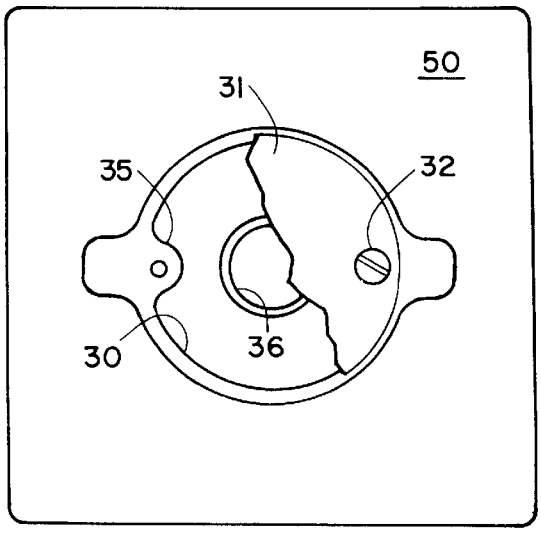
PRIOR ART FIG. 2
FIG. 2 is a plan view of a prior art tab-like lid fastener receiving member.
Figure 1:
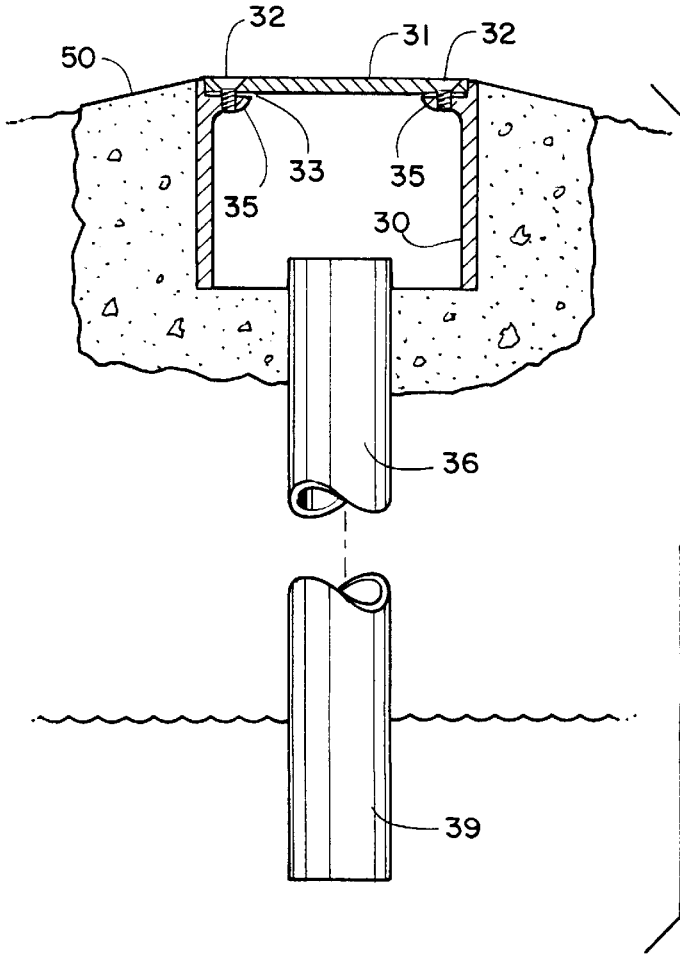
PRIOR ART FIG. 1
FIG. 1 is sectional view of a typical monitoring well placement and structure.
Figure 4:
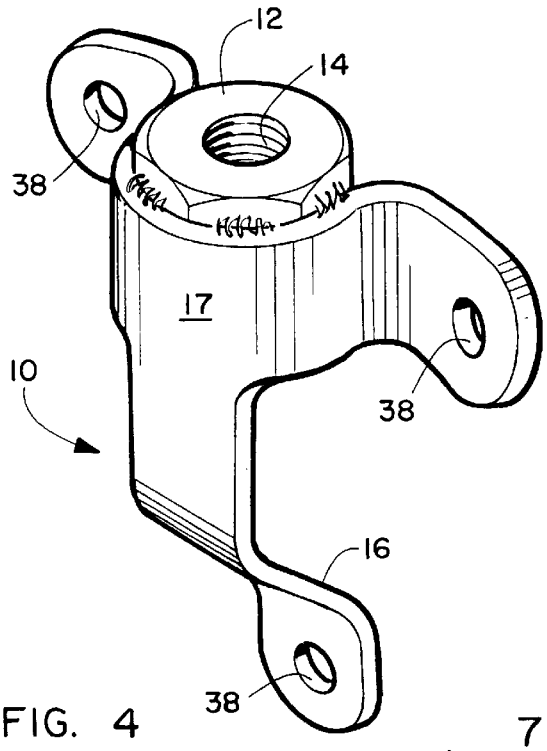
FIG. 4 is a perspective view of the lid retainer of the present invention.
Figure 5:
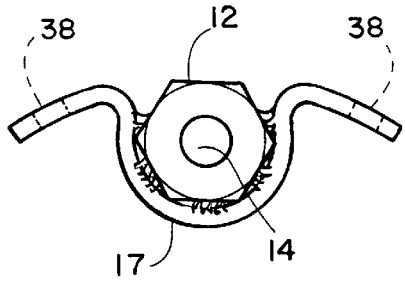
FIG. 5 is a plan view of the lid retainer of the present invention.
Figure 6:
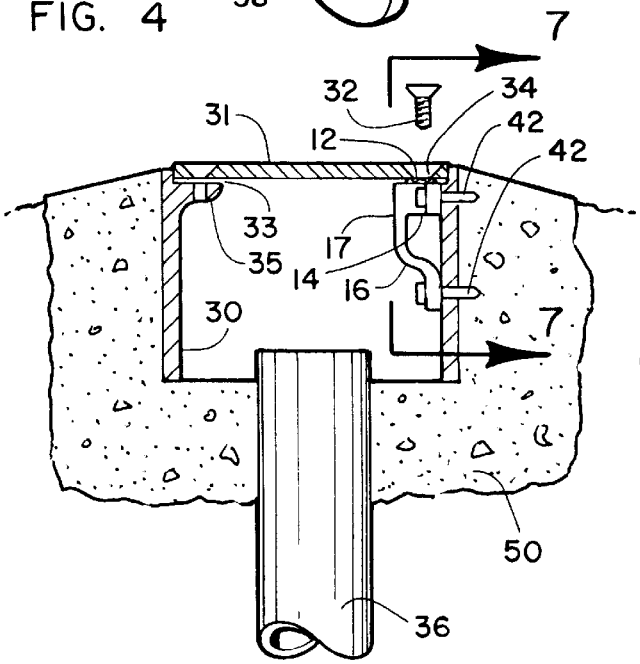
FIG. 6 is a partial sectional view of the lid retainer of the present invention in place in a monitoring well.
Figure 7:
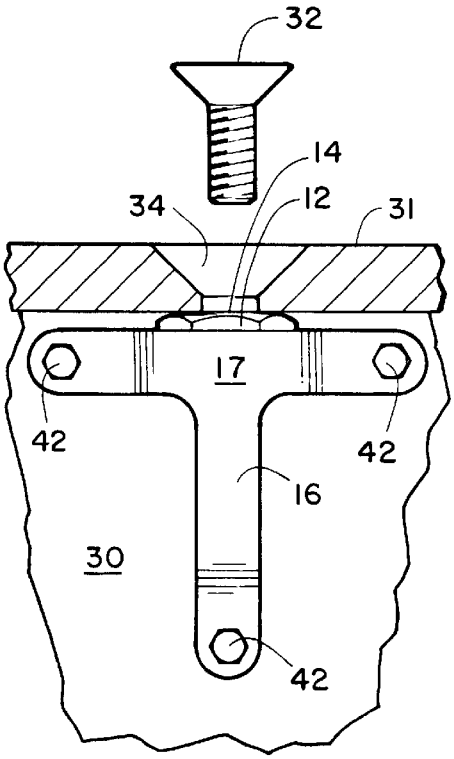
FIG. 7 is another partial sectional view taken on line 7—7 of FIG. 6 of the lid retainer of the present invention.

Referring now to the drawings in detail and in particular to FIG. 1, which illustrates a typical ground monitoring well 30 in place. It is seated in a concrete berm 50. The berm 50 may be flush with the surface or, from its perimeter, inclined and raised to its center. The monitoring well 30 is seated in the center. The monitoring well 30 is covered by a lid 31. The lid 31 is secured to the monitoring well 30 by at least one lid fastener 32 (in this case two bolts) and cooperating lid fastener receiving member 35 (in this case a cooperating threaded tab-like members). See also FIG. 2. A monitoring member 36 projects into the monitoring well at one end and past the berm 50 and into the ground at another end. The monitoring member has a plurality of apertures or slits 39 which permit ground water to flow therethrough and collect therein. It is this water that is subject to periodic testing. Ideally, the lid fasteners should be fully seated and not project above the lid 31. If they project above the lid, generally a spacing exists between the bottom of the head of a lid fastener and the lid. The spacing permits movement of the lid fastener 32 when pressure or force is exerted on the lid fastener 32. The lid fastener 32 in FIGS. 1 and 6 illustrate an improper seating. The spacing referred to above is designated by reference numeral 33. Such improper seating will damage the tab-like lid fastener receiving member when sufficient weight or pressure is applied to the protruding lid fastener 32.

Figure 3:
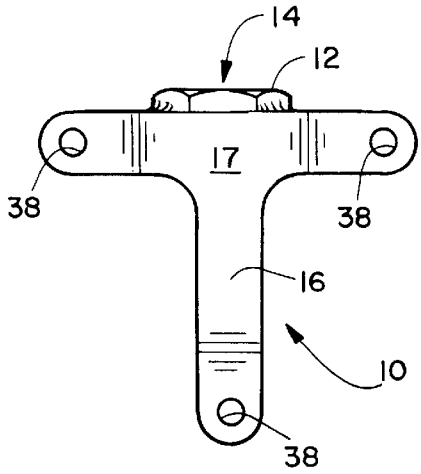
FIG. 3 is a front elevation view of the lid retainer of the present invention.

FIG. 3, reference character 10 generally designates a lid retainer constructed in accordance with a preferred embodiment of the present invention. It comprises a lid fastener receiving member 12 which may include any suitable such receiving member capable of cooperating with the lid fastener being used in the fastening application. Typical cooperating lid fasteners and lid fastener receiving members include, but are not limited to, a bolt and a nut. As used in this embodiment where a bolt is being used as the lid fastener, the lid fastener receiving member includes a cooperating nut having a threaded aperture 14.

A first brace member 17 is securely and generally permanently attached to the lid fastener receiving member 12. In this embodiment, the first brace member 17 is a somewhat flexible horizontally disposed strip-like structure which is somewhat curvilinearly disposed around the lid fastener receiving member. It is fixed to the shape of the lid fastener receiving member and securely connected thereto. Any brace member suited for the intended purpose may be used. What is important here is that the brace member be may of a somewhat flexible material to that the brace member may be shaped to the contours of the inside of the housing 30 when installed or so that the brace member may be re-shaped, without removal, in the event of damage to the brace member.

The lid retainer 10 is fastened to the inside of the housing of the monitoring well 30 by any suitable attachment means. In the preferred embodiment, the attachment means include at least one aperture 38 on the first brace member 17. Any suitable fastener 42, such as an anchor device with cooperating bolt or screw, or a concrete anchor may be used for this purpose. Concrete anchors are preferred in the installation process. The key here is to ensure a secure attachment to the housing.

The first brace member 17 ideally is structured securely around the outer perimeter of the lid fastener receiving member and, because of its flexibility, contours and assumes the shape of the inner surface housing of the monitoring well 30. Its curvilinear structure about the lid fastener receiving member followed by extensions which contour to the shape of the inner surface of the housing provide lateral support for the lid retainer 10.

For added support and strength, a second brace member 16, is perpendicularly disposed from the first brace member 17. The second brace member 16, ideally is also a somewhat flexible strap-like component having at least one aperture 38 thereon for contouring to the inner surface housing of the monitoring well and attaching thereto is similar fashion as the first brace member 17 above-described. The flexibility of the brace members permits the lid retainer 10 to give-way rather than break when the lid fastener 32 is improperly seated. From its connection to the first brace member 17, the second brace member 16 angles downward and toward the inner surface of the housing after which it extends further downward. It is in this downward extension that the attaching apertures are structured. This angle and extension provide strength and support and, to some degree, resistance to damage, for the lid retainer 10.

When a tab-like lid fastener receiving member of the prior art is damaged or broken, the lid retainer 10 of the present invention is easily attached to the inner surface housing of the monitoring well 30 adjacent to the lid 31 and the lid holes 34. FIG. 6 illustrates the placement of the lid retainer 10 thereat. In my preferred embodiment which uses a nut as the lid fastener receiving member, we see that the lid fastener 32, a bolt in this case, inserts through a corresponding lid hole 34 in the lid 31 and is in fastening communication with the hole 14 of the lid fastener receiving member 12.

Placement of my lid retainer 10 is determined by the lid holes 34 on the lid 31. The lid fastener receiving member 12 must be aligned with the lid holes 34. After so placed, and aligned, the lid retainer 10 is fitted to the contours of the inside surface of the housing of the monitoring well 30. The flexible brace members 16 and 17 are adjustable to that contour and the respective apertures 38 marked for attachment preparation. The lid retainer 10 is attached thereto by any of the means above-described. The lid 31 is aligned with the replaced lid retainer 10. The fastener 32 is seated and secured into the lid fastener receiving member 12 such that the fastener 32 is flush or recessed in relation to the lid surface (depending on the structure of the lid 31 associated with the monitoring well). The water-tight integrity of the monitoring well 30 is restored and maintained without resorting to a costly replacement of the entire monitoring well 30. Should an attendant failed to properly seat the lid fasteners 32 in the future and the lid retainer 10 is later damaged, the lid retainer 10, because of its flexibility, may be re-shaped or if damaged beyond repair, may be replaced by a new lid retainer 10; generally placed below that of the damaged lid retainer.

The method for installation includes removing the old tabbed receiving members 35, aligning the lid retainer device 10 with the lid 31 and its holes 34, drilling a hole aligned with the apertures 38 of the respective brace members 16 and 17 through the housing 30 and into the concrete berm 50, and inserting and tightening the concrete anchor through the apertures 38 and into the holes drilled in the concrete berm 50. The holes drilled in the concrete berm 50 must be compatible with the concrete anchors such that the concrete anchors will be secured into the concrete berm 50 and will securely hold the lid retainer 10 thereon.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiment illustrated, but by the appended claims and their legal equivalents.

The invention claimed is:

1. In a ground-water monitoring well having a housing, a lid for the housing said lid being attachable thereto, and at least one lid fastener for fastening the lid to the housing, a lid retainer comprising:

a. a lid fastener receiving member;

b. a first brace member connected to said lid fastener receiving member, said first brace member adapted to securely receive and retain said at least one lid fastener; and c. attachment means for attaching said lid retainer to said housing, said attachment means comprising a second brace member perpendicularly adjacent to said first brace member and at least one aperture on said first brace member, said aperture adapted to receive a brace fastener to secure said lid retainer to said housing, whereby when said lid is placed on said housing it is securely attached thereto by said at least one lid fastener being inserted and secured into said lid fastener receiving member to form a water-tight seal on said monitoring well.

2. The lid retainer as defined in claim 1 wherein said attachment means comprises at least one flexible extension on said first brace member, said at least one flexible extension adapted to adjust said lid retainer to cooperate with said lid fastener.

3. The lid retainer defined in claim 1 wherein said attachment means further comprises at least one flexible extension on said second brace member, said at least one flexible extension adapted to adjust said lid retainer to cooperate with said lid fastener.

4. The lid retainer as defined in claim 1 wherein said attachment means further comprises at least one aperture on said second brace member, said aperture of said second brace member is adapted to receive a brace fastener to secure said lid retainer to said housing.

* * * * *